US009425560B1

(12) United States Patent
Su et al.

(10) Patent No.: US 9,425,560 B1
(45) Date of Patent: Aug. 23, 2016

(54) ELECTRICAL CONNECTOR

(71) Applicant: Cheng Uei Precision Industry Co., Ltd., New Taipei (TW)

(72) Inventors: Yu-Hung Su, New Taipei (TW); Chin-Chou Wang, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/884,752

(22) Filed: Oct. 15, 2015

(51) Int. Cl.
*H01R 13/6594* (2011.01)

(52) U.S. Cl.
CPC ..... *H01R 13/6594* (2013.01)

(58) Field of Classification Search
CPC ..... H01R 13/6581; H01R 13/6594; H01R 13/6591
See application file for complete search history.

(56) References Cited

U.S. PATENT DOCUMENTS 6,827,610 B2 * 12/2004 Lin ..... H01R 12/721 439/566
6,997,748 B1 * 2/2006 Su ..... H01R 13/65802 439/607.55
7,465,194 B1 * 12/2008 Ho ..... H01R 9/032 439/607.01
7,748,999 B1 * 7/2010 Sun ..... H01R 12/716 439/607.36
7,837,506 B1 * 11/2010 Chiang ..... H01R 13/506 439/607.27
7,922,535 B1 * 4/2011 Jiang ..... H01R 13/5205 439/271
8,052,467 B1 * 11/2011 Xie ..... H01R 13/5219 439/589
8,070,516 B2 * 12/2011 Chiang ..... H01R 13/6595 439/607.27
8,083,549 B1 * 12/2011 Chiang ..... H01R 13/6581 439/607.55
8,262,414 B1 * 9/2012 Li ..... H01R 13/6273 439/607.35
8,292,662 B2 * 10/2012 Yang ..... H01R 13/5202 439/271
8,292,674 B1 * 10/2012 Yang ..... H01R 12/57 439/587
8,333,614 B2 * 12/2012 Xiong ..... H01R 12/716 439/660
8,337,245 B1 * 12/2012 Wang ..... H01R 12/724 439/271
8,348,688 B2 * 1/2013 Liu ..... H01R 13/5219 439/271
8,388,380 B1 * 3/2013 Van der Steen .... H01R 13/5202 439/607.36
8,535,097 B2 * 9/2013 Yen ..... H01R 12/724 439/607.27
8,597,051 B2 * 12/2013 Yang ..... H01R 12/57 439/589
8,662,928 B1 * 3/2014 Xie ..... H01R 13/6594 439/607.35
8,790,138 B2 * 7/2014 Wang ..... H01R 27/02 439/607.4
8,882,540 B2 * 11/2014 Yen ..... H01R 27/00 439/489
8,961,230 B2 * 2/2015 Chou ..... H01R 9/032 439/607.27
9,011,178 B2 * 4/2015 Hori ..... H01R 13/6581 29/842
9,088,108 B2 * 7/2015 Zhao ..... H01R 13/6581
9,093,797 B2 * 7/2015 Zhao ..... H01R 12/707
9,093,806 B1 * 7/2015 Yang ..... H01R 24/60
9,106,024 B2 * 8/2015 Zhao ..... H01R 13/6594
9,112,296 B2 * 8/2015 Zhang ..... H01R 13/516
9,136,623 B2 * 9/2015 Hamada ..... H01R 12/724
9,209,573 B1 * 12/2015 Chen ..... H01R 13/6581
9,281,608 B2 * 3/2016 Zhao ..... H01R 12/57
9,281,642 B1 * 3/2016 Tseng ..... H01R 24/60
9,281,643 B1 * 3/2016 Tseng ..... H01R 13/518

(Continued)

*Primary Examiner* — Ross Gushi
(74) *Attorney, Agent, or Firm* — Cheng-Ju Chiang

(57) ABSTRACT

An electrical connector includes a docking module, a shielding shell and a metal cover. The shielding shell has a top plate, two lateral plates, a bottom plate and a receiving space. Front ends of the two lateral plates are punched outward to form two barbs. Middles of the two lateral plates bulge outward to form two convex portions. The metal cover is covered downward on the shielding shell. The metal cover has a base plate and two side plates. The two side plates define a plurality of openings. Bottom edges of the two side plates are recessed upward to form a plurality of guiding notches. Each of the guiding notches is located below one of the openings. The barbs and the convex portions are guided along the guiding notches to be fastened in the openings.

17 Claims, 5 Drawing Sheets

(56) References Cited

U.S. PATENT DOCUMENTS 9,306,300 B2 * 4/2016 Chung ..... H01R 12/51
9,306,337 B2 * 4/2016 Yu ..... H01R 24/60
9,312,644 B2 * 4/2016 Kao ..... H01R 13/6591
9,318,856 B2 * 4/2016 MacDougall ..... H01R 13/6581
9,325,128 B2 * 4/2016 Chen ..... H01R 12/724
9,337,588 B2 * 5/2016 Chang ..... H01R 13/6594
9,350,121 B2 * 5/2016 Ju ..... H01R 13/6585
9,356,406 B2 * 5/2016 Yen ..... H01R 24/60
2010/0173524 A1 * 7/2010 Zhu ..... H01R 13/65802 439/607.01
2011/0034078 A1 * 2/2011 Nagata ..... H01R 12/712 439/607.01
2011/0269343 A1 * 11/2011 Chen ..... H01R 24/60 439/626
2012/0225583 A1 * 9/2012 Kamarauskas ..... H01R 13/41 439/607.01
2012/0231675 A1 * 9/2012 Zhang ..... H01R 13/6594 439/682
2013/0323944 A1 * 12/2013 Hamada ..... H01R 12/724 439/65
2013/0344739 A1 * 12/2013 Shih ..... H01R 13/658 439/607.28
2014/0302709 A1 * 10/2014 Zhao ..... H01R 12/57 439/519
2015/0155661 A1 * 6/2015 Chen ..... H01R 13/6594 439/607.01
2015/0194768 A1 * 7/2015 Little ..... H01R 13/6594 439/607.37
2015/0200504 A1 * 7/2015 Little ..... H01R 24/60 439/345
2015/0207280 A1 * 7/2015 Little ..... H01R 24/60 439/607.34
2015/0229077 A1 * 8/2015 Little ..... H01R 13/6582 439/78
2015/0244111 A1 * 8/2015 Ju ..... H01R 13/6585 439/607.05
2015/0270646 A1 * 9/2015 Kao ..... H01R 13/6581 439/76.1
2015/0270659 A1 * 9/2015 Kao ..... H01R 24/64 439/607.01
2015/0270661 A1 * 9/2015 Kao ..... H01R 13/5202 439/271
2015/0303623 A1 * 10/2015 Kao ..... H01R 13/6583 439/607.04
2015/0333451 A1 * 11/2015 Kao ..... H01R 13/6596 439/607.01
2015/0340791 A1 * 11/2015 Kao ..... H01R 13/42 439/676
2015/0380870 A1 * 12/2015 Kao ..... H01R 13/6583 439/607.01
2015/0380871 A1 * 12/2015 Kao ..... H01R 13/6658 439/607.27
2016/0006195 A1 * 1/2016 Zhao ..... H01R 13/405 439/676
2016/0013592 A1 * 1/2016 Kao ..... H01R 13/6471 439/607.55
2016/0013593 A1 * 1/2016 Kao ..... H01R 13/6585 439/607.01
2016/0020537 A1 * 1/2016 Ju ..... H01R 24/78 439/83
2016/0020560 A1 * 1/2016 Ju ..... H01R 24/78 439/607.05
2016/0020569 A1 * 1/2016 Ju ..... H01R 24/78 439/607.01
2016/0020572 A1 * 1/2016 Ju ..... H01R 24/78 264/272.14
2016/0028190 A1 * 1/2016 Chen ..... H01R 13/6581 439/607.01
2016/0043511 A1 * 2/2016 Hsu ..... H01R 13/6585 439/607.05
2016/0049751 A1 * 2/2016 Chuang ..... H01R 13/6581 439/217
2016/0056586 A1 * 2/2016 Guo ..... H01R 13/41 439/607.05
2016/0064866 A1 * 3/2016 Kao ..... H01R 13/6596 439/676
2016/0064868 A1 * 3/2016 Little ..... H01R 13/6581 439/607.01
2016/0064872 A1 * 3/2016 Leng ..... H01R 24/60 439/607.05
2016/0064877 A1 * 3/2016 Tamaki ..... H01R 13/508 439/676
2016/0064879 A1 * 3/2016 Yen ..... H01R 24/78 439/607.01
2016/0079712 A1 * 3/2016 Chung ..... H01R 24/60 439/607.55
2016/0104957 A1 * 4/2016 Kim ..... H01R 13/6581 439/78
2016/0104972 A1 * 4/2016 Feng ..... H01R 13/6581 439/607.27
2016/0104975 A1 * 4/2016 Guo ..... H01R 43/16 439/607.05
2016/0104976 A1 * 4/2016 Yu ..... H01R 13/6585 439/607.05
2016/0118750 A1 * 4/2016 Guo ..... H01R 12/7005 439/78
2016/0118752 A1 * 4/2016 Guo ..... H01R 13/6594 439/78
2016/0126677 A1 * 5/2016 Yu ..... H01R 13/6581 439/607.23
2016/0141792 A1 * 5/2016 Zhao ..... H01R 13/5202 439/78
2016/0141804 A1 * 5/2016 Kao ..... H01R 13/6581 439/607.01
2016/0141805 A1 * 5/2016 Zhao ..... H01R 13/6581 439/607.01
2016/0141806 A1 * 5/2016 Guo ..... H01R 13/6581 439/607.01
2016/0149345 A1 * 5/2016 Liu ..... H01R 13/6581 439/607.01
2016/0149348 A1 * 5/2016 Kao ..... H01R 13/6585 439/607.05
2016/0149349 A1 * 5/2016 Kao ..... H01R 13/6585 439/607.05
2016/0149350 A1 * 5/2016 Kao ..... H01R 13/6585 439/607.05

* cited by examiner

ELECTRICAL CONNECTOR

BACKGROUND OF THE INVENTION

1. Field of the Invention

The present invention generally relates to a connector, and more particularly to an electrical connector.

2. The Related Art

With the development of electronic products, a variety of the electronic products are connected with peripheral devices more and more frequently. The electronic products are usually connected with the peripheral devices by electrical connectors.

A conventional electrical connector includes an insulating housing, a plurality of terminals and a shielding shell. The terminals are integrally molded to the insulating housing. The shielding shell surrounds the insulating housing. The shielding shell has a top plate, two lateral plates extended downward from two opposite sides of the top plate, a bottom plate connected between bottom edges of the two lateral plates, and a rear plate bent downward from a rear edge of the top plate. The top plate, the two lateral plates, the bottom plate and the rear plate surround a receiving space thereamong. The insulating housing together with the terminals is received in the receiving space.

However, assembling procedures of the conventional electrical connector are generally complex, and the electrical connector is connected with a butting connector unstably. As a result, transmission signals between the conventional electrical connector and the butting connector are affected.

Thus, in order to effectively overcome the aforesaid drawbacks, an innovative electrical connector which has a reasonable-designed structure need be developped, the innovative electrical connector is capable of simplifying assembling procedures of the innovative electrical connector and making electrical connector connected with the butting connector stably.

SUMMARY OF THE INVENTION

An object of the present invention is to provide an electrical connector. The electrical connector includes a docking module, a shielding shell and a metal cover. The shielding shell has a top plate, two lateral plates bent downward from two opposite sides of the top plate, a bottom plate connected between two bottoms of the two lateral plates, and a receiving space formed among the top plate, the two lateral plates and the bottom plate. The docking module is received in the receiving space. Front ends of the two lateral plates are punched outward to form two barbs. Middles of the two lateral plates bulge outward to form two convex portions. The metal cover is covered downward on the shielding shell. The metal cover has a base plate, and two side plates extended downward from two opposite sides of the base plate. The two side plates define a plurality of openings corresponding to the barbs and the convex portions. Bottom edges of the two side plates are recessed upward to form a plurality of guiding notches. Each of the guiding notches is correspondingly located below one of the openings. The barbs and the convex portions are guided along the guiding notches to be fastened in the corresponding openings.

As described above, the barbs and the convex portions of the shielding shell are guided along the guiding notches to be fastened in the corresponding openings of the metal cover, so that the electrical connector has a reasonable-designed structure to make the electrical connector simplify assembling procedures of the electrical connector, and provide accurate locations for the metal cover and the shielding shell of the electrical connector for ensuring the electrical connector connected with a butting connector stably. As a result, transmission signals between the electrical connector and the butting connector are steady.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

With reference to FIG. 1 to FIG. 5, an electrical connector 100 in accordance with the present invention is shown. The electrical connector 100 includes a docking module 10, a shielding shell 20 and a metal cover 30.

Figure 2:
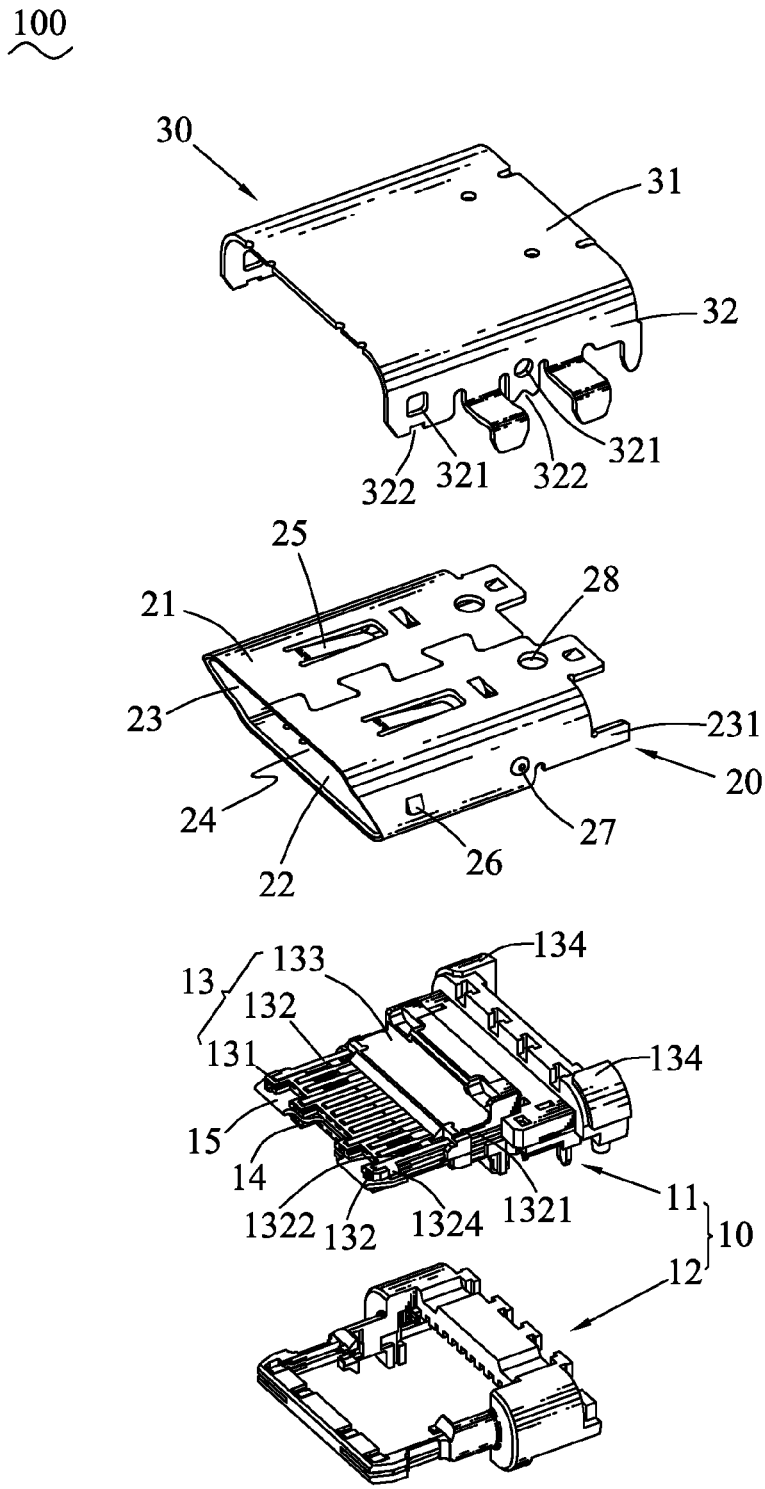
FIG. 2 is an exploded view of the electrical connector of FIG. 1.
Figure 3:
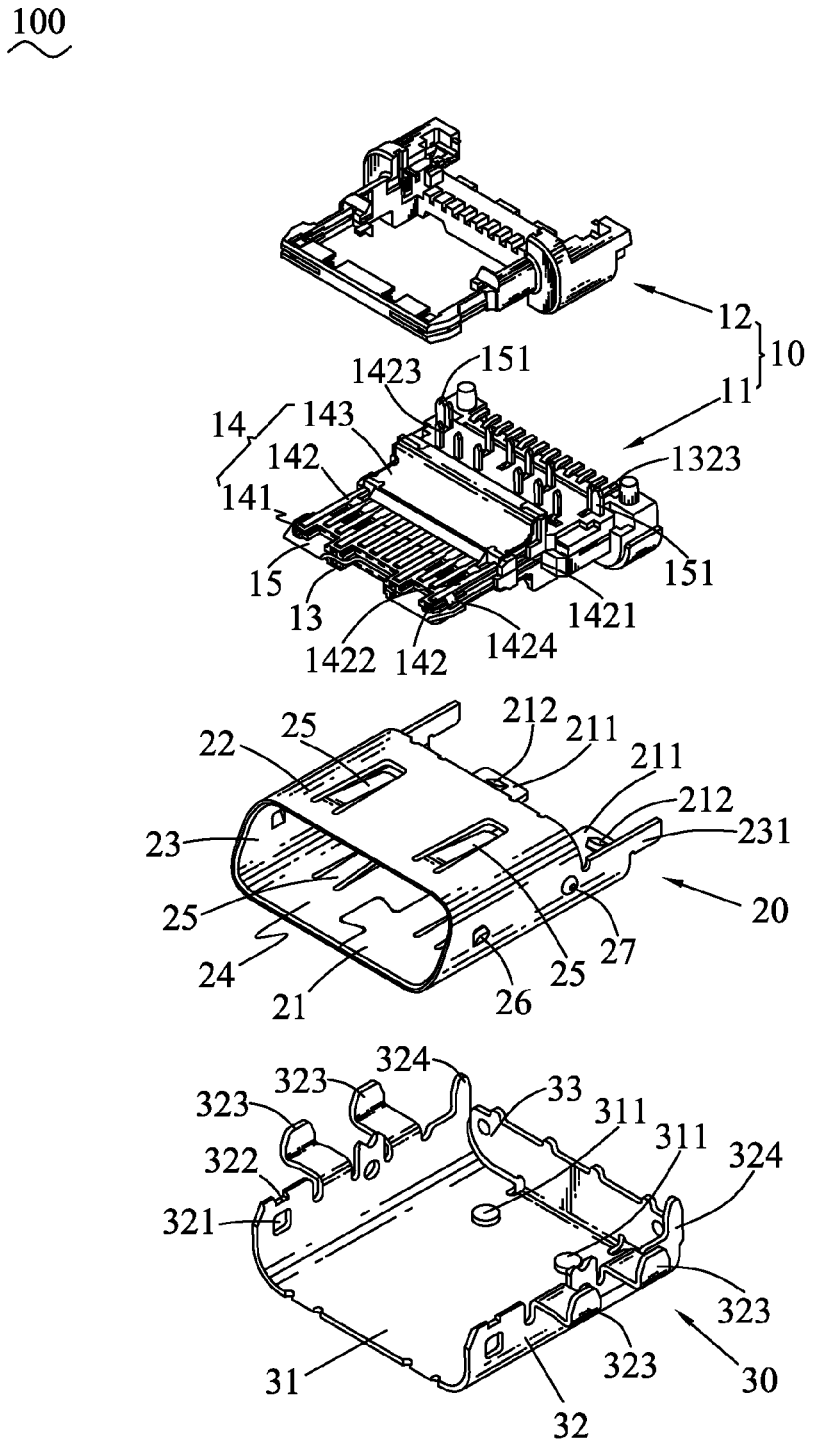
FIG. 3 is another exploded view of the electrical connector of FIG. 1.

Referring to FIG. 2 and FIG. 3, the docking module 10 includes a terminal module 11 and an insulating body 12. The insulating body 12 is integrally molded to the terminal module 11. The terminal module 11 includes a first terminal pack 13, a second terminal pack 14 and a ground component 15. The ground component 15 is mounted between the first terminal pack 13 and the second terminal pack 14. Rears of two opposite sides of the ground component 15 are bent downward to form two soldering arms 151.

Figure 5:
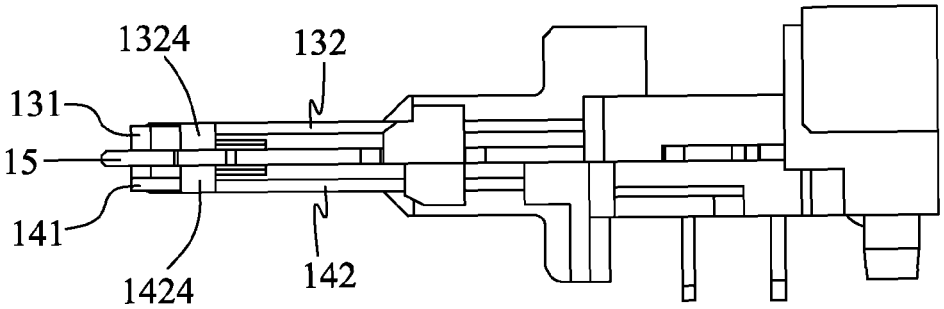
FIG. 5 is a right side view showing that the electrical connector in accordance with the present invention is without a shielding shell and a first metal cover.

Referring to FIG. 2, FIG. 3 and FIG. 5, the first terminal pack 13 includes a first base body 131, a plurality of first terminals 132 and a first shielding part 133. The first terminals 132 are integrally molded to the first base body 131. The first shielding part 133 is fastened on an upper portion of the first base body 131. The first shielding part 133 is without contacting the first terminals 132. Two opposite sides of the first base body 131 protrude outward to form two blocking portions 134. Specifically, each of the first terminals 132 has a first fastening portion 1321, a first contact portion 1322 extended forward from a front end of the first fastening portion 1321, and a first soldering portion 1323 bent downward and extending rearward from a rear end of the first fastening portion 1321. Front ends of outer sides of the first contact portions 1322 of the two first terminals 132 respectively adjacent to two opposite side edges of the first base body 131 are bent downward and then protrude outward to form two first connecting arms 1324. The first fastening portion 1321 is molded to the first base body 131. The first contact portion 1322 is exposed to the upper portion of the first base body 131. The first soldering portion 1323 projects out of the first base body 131.

Referring to FIG. 2, FIG. 3 and FIG. 5, the second terminal pack 14 includes a second base body 141, a plurality of second terminals 142 and a second shielding part 143. The second terminals 142 are integrally molded to the second base body 141. The second shielding part 143 is fastened to a lower portion of the second base body 141. The second shielding part 143 is without contacting the second terminals 142. Specifically, each of the second terminals 142 has a second fastening portion 1421, a second contact portion 1422 extended forward from a front end of the second fastening portion 1421, and a second soldering portion 1423 bent downward from a rear end of the second fastening portion 1421. Front ends of outer sides of the second contact portions 1422 of the two second terminals 142 respectively adjacent to two opposite side edges of the second base body 141 are bent upward and then protrude outward to form two second connecting arms 1424. The second fastening portion 1421 is molded to the second base body 141. The second contact portion 1422 is exposed to the lower portion of the second base body 141. The second soldering portion 1423 projects out of the second base body 141.

Referring to FIG. 2, FIG. 3 and FIG. 5, the ground component 15 is mounted on the second terminal pack 14. The soldering arms 151 project beyond a bottom surface of the second base body 141. The two second connecting arms 1424 are located at and are connected with the bottom surface of the ground component 15 to effectively decrease the generation of the high-frequency convex wave phenomenon so as to make the high-frequency waveform steadily transmitted. The first terminal pack 13 is mounted on the ground component 15. The two first connecting arms 1324 are located on and are connected with a top surface of the ground component 15 to effectively decrease a generation of a high-frequency convex wave phenomenon so as to make a high-frequency waveform steadily transmitted.

Figure 1:
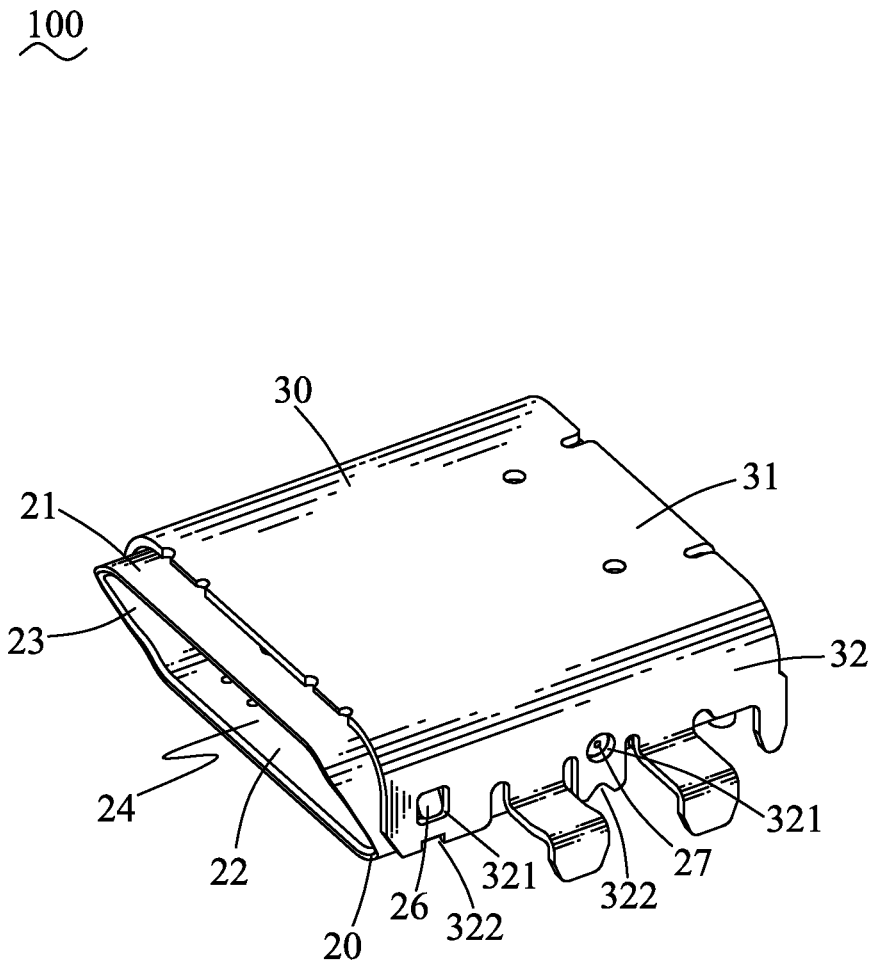
FIG. 1 is a perspective view of an electrical connector in accordance with the present invention.

Referring to FIG. 1 and FIG. 2, the shielding shell 20 surrounds the docking module 10. The shielding shell 20 has a top plate 21, two lateral plates 23 bent downward from two opposite sides of the top plate 21, a bottom plate 22 connected between two bottoms of the two lateral plates 23, and a receiving space 24 formed among the top plate 21, the two lateral plates 23 and the bottom plate 22.

Figure 4:
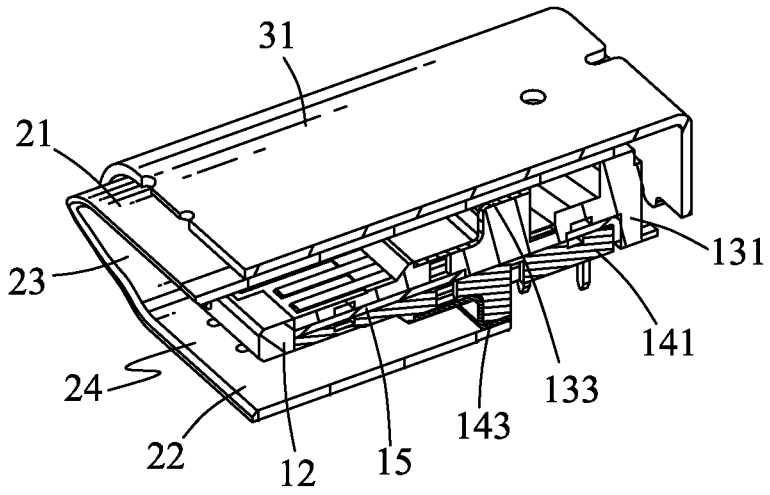
FIG. 4 is a sectional view of the electrical connector of FIG. 1.

Referring to FIG. 2, FIG. 3 and FIG. 4, the docking module 10 is received in the receiving space 24. The first shielding part 133 electrically contacts the top plate 21 of the shielding shell 20. The second shielding part 143 electrically contacts the bottom plate 22 of the shielding shell 20. Several portions of the top plate 21 and the bottom plate 22 of the shielding shell 20 are punched inward to form a plurality of elastic pieces 25 elastically connected with a butting connector (not shown) and providing a ground breakover between the electrical connector 100 and the butting connector. Front ends of the two lateral plates 23 are punched outward to form two barbs 26. Middles of the two lateral plates 23 bulge outward to form two convex portions 27. Two sides of a rear end of the top plate 21 of the shielding shell 20 define two fastening holes 28.

Two opposite sides of the top plate 21 of the shielding shell 20 protrude rearward to form two first blocking slices 211. Each of the first blocking slices 211 is punched downward to form an abutting piece 212. Rears of the two lateral plates 23 of the shielding shell 20 extend rearward to form two second blocking slices 231. Outer side edges of the two first blocking slices 211 abut against inner surfaces of the two blocking portions 134. Top edges of the two second blocking slices 231 abut against bottoms of the two blocking portions 134. Rear edges of the two lateral plates 23 of the shielding shell 20 abut against front surfaces of the two blocking portions 134. The abutting piece 212 abuts against a rear surface of the first base body 131.

Referring to FIG. 2 and FIG. 3, the metal cover 30 has a base plate 31, two side plates 32 extended downward from two opposite sides of the base plate 31, and a rear plate 33 bent downward from a rear edge of the base plate 31. Two opposite sides of a rear end of the base plate 31 of the metal cover 30 protrude downward to form two fastening pillars 311 corresponding to the two fastening holes 28. The two side plates 32 define a plurality of openings 321 corresponding to the barbs 26 and the convex portions 27. Bottom edges of the two side plates 32 are recessed upward to form a plurality of guiding notches 322. Each of the guiding notches 322 is correspondingly located below one of the openings 321. Several portions of substantial middles of bottoms of the two side plates 32 of the metal cover 30 extend outward and then protrude downward to form a plurality of first soldering feet 323. Rears of the bottoms of the two side plates 32 of the metal cover 30 extend downward to form two second soldering feet 324.

Referring to FIG. 1 to FIG. 5, the metal cover 30 is covered downward on the shielding shell 20. The barbs 26 and the convex portions 27 are guided along the guiding notches 322 to be fastened in the corresponding openings 321. The fastening pillars 311 are fastened to the fastening holes 28. After the metal cover 30 is completed being assembled to the shielding shell 20, the metal cover 30 is combined with the shielding shell 20 by virtue of a laser welding technology. So the metal cover 30 is combined with the shielding shell 20 tightly for improving a tolerance degree of a mechanism test. The rear plate 33 of the metal cover 30 blocks behind a rear of the docking module 10.

When the electrical connector 100 is mounted to a circuit board (not shown), the soldering arms 151 are soldered to the circuit board. The first soldering portion 1323 is soldered to the circuit board. The second soldering portion 1423 is soldered to the circuit board. The first soldering feet 323 and the second soldering feet 324 are soldered to the circuit board.

As described above, the barbs 26 and the convex portions 27 of the shielding shell 20 are guided along the guiding notches 322 to be fastened in the corresponding openings 321 of the metal cover 30, so that the electrical connector 100 has a reasonable-designed structure to simplify assembling procedures of the electrical connector 100, and provide accurate locations for the metal cover 30 and the shielding shell 20 of the electrical connector 100 for making the electrical connector 100 connected with the butting connector stably. As a result, transmission signals between the electrical connector 100 and the butting connector are steady.

What is claimed is:

1. An electrical connector, comprising:

a docking module;

a shielding shell having a top plate, two lateral plates bent downward from two opposite sides of the top plate, a bottom plate connected between two bottoms of the two lateral plates, and a receiving space formed among the top plate, the two lateral plates and the bottom plate, the docking module being received in the receiving space, front ends of the two lateral plates being punched outward to form two barbs, middles of the two lateral plates bulging outward to form two convex portions; and a metal cover covered downward on the shielding shell, the metal cover having a base plate, and two side plates extended downward from two opposite sides of the base plate, the two side plates defining a plurality of openings corresponding to the barbs and the convex portions, bottom edges of the two side plates being recessed upward to form a plurality of guiding notches, each of the guiding notches being correspondingly located below one of the openings, the barbs and the convex portions being guided along the guiding notches to be fastened in the corresponding openings.

2. The electrical connector as claimed in claim 1, wherein two sides of a rear end of the top plate of the shielding shell define two fastening holes, two opposite sides of a rear end of the base plate of the metal cover protrude downward to form two fastening pillars, the fastening pillars are fastened to the fastening holes.

3. The electrical connector as claimed in claim 1, wherein the metal cover is combined with the shielding shell by virtue of a laser welding technology.

4. The electrical connector as claimed in claim 1, wherein several portions of the top plate and the bottom plate of the shielding shell are punched inward to form a plurality of elastic pieces elastically connected with a butting connector.

5. The electrical connector as claimed in claim 1, wherein the docking module includes a terminal module and an insulating body, the insulating body is integrally molded to the terminal module.

6. The electrical connector as claimed in claim 5, wherein the terminal module includes a first terminal pack, a second terminal pack and a ground component, the ground component is mounted between the first terminal pack and the second terminal pack.

7. The electrical connector as claimed in claim 6, wherein the first terminal pack includes a first base body, a plurality of first terminals and a first shielding part, the first terminals are integrally molded to the first base body, the first shielding part is fastened on an upper portion of the first base body, the first shielding part is without contacting the first terminals, the first shielding part electrically contacts the top plate of the shielding shell.

8. The electrical connector as claimed in claim 7, wherein each of the first terminals has a first fastening portion molded to the first base body, and a first contact portion extended forward from a front end of the first fastening portion, the first contact portion is exposed to the upper portion of the first base body, front ends of outer sides of the first contact portions of the two first terminals respectively adjacent to two opposite side edges of the first base body are bent downward and then protrude outward to form two first connecting arms, the two first connecting arms are located on and are connected with a top surface of the ground component.

9. The electrical connector as claimed in claim 8, wherein each of the first terminals has a first soldering portion bent downward and extending rearward from a rear end of the first fastening portion, the first soldering portion projects out of the first base body and is soldered to a circuit board.

10. The electrical connector as claimed in claim 6, wherein the second terminal pack includes a second base body, a plurality of second terminals and a second shielding part, the second terminals are integrally molded to the second base body, the second shielding part is fastened to a lower portion of the second base body, the second shielding part is without contacting the second terminals, the second shielding part electrically contacts the bottom plate of the shielding shell.

11. The electrical connector as claimed in claim 10, wherein each of the second terminals has a second fastening portion molded to the second base body, a second contact portion extended forward from a front end of the second fastening portion, the second contact portion is exposed to the lower portion of the second base body, front ends of outer sides of the second contact portion of the two second terminals adjacent to two opposite side edges of the second base body are bent upward and then protrude outward to form two second connecting arms, the two second connecting arms are located at and are connected with a bottom surface of the ground component.

12. The electrical connector as claimed in claim 11, wherein each of the second terminals has a second soldering portion bent downward from a rear end of the second fastening portion, the second soldering portion projects out of the second base body and is soldered to a circuit board.

13. The electrical connector as claimed in claim 6, wherein rears of two opposite sides of the ground component are bent downward to form two soldering arms, the soldering arms are soldered to a circuit board.

14. The electrical connector as claimed in claim 6, wherein the first terminal pack includes a first base body, two opposite sides of the first base body protrude outward to form two blocking portions, two opposite sides of the top plate of the shielding shell protrude rearward to form two first blocking slices, rears of the two lateral plates of the shielding shell extend rearward to form two second blocking slices, outer side edges of the two first blocking slices abut against inner surfaces of the two blocking portions, top edges of the two second blocking slices abut against bottoms of the two blocking portions, rear edges of the two lateral plates of the shielding shell abut against front surfaces of the two blocking portions.

15. The electrical connector as claimed in claim 14, wherein each of the first blocking slices is punched downward to form an abutting piece, the abutting piece abuts against a rear surface of the first base body.

16. The electrical connector as claimed in claim 1, wherein the metal cover has a rear plate bent downward from a rear edge of the base plate, the rear plate of the metal cover blocks behind a rear of the docking module.

17. The electrical connector as claimed in claim 1, wherein several portions of substantial middles of bottoms of the two side plates of the metal cover extend outward and then protrude downward to form a plurality of first soldering feet, rears of the bottoms of the two side plates of the metal cover extend downward to form two second soldering feet, the first soldering feet and the second soldering feet are soldered to a circuit board.

* * * * *